United States Patent [19]

Lichtenstein et al.

[11] 4,232,443

[45] Nov. 11, 1980

[54] WIRE INSERTION GUIDE

[75] Inventors: Bernard Lichtenstein; Edward Nemeth, both of Fair Lawn, N.J.

[73] Assignee: VIP Industries, Inc., Paterson, N.J.

[21] Appl. No.: 23,669

[22] Filed: Mar. 26, 1979

[51] Int. Cl.[3] ..... H01R 43/04

[52] U.S. Cl. ..... 29/753; 29/760; 72/402; 72/422; 72/428

[58] Field of Search ..... 29/753, 751, 760; 72/402, 422, 428, 293

[56] References Cited

U.S. PATENT DOCUMENTS

| | | | |
|---|---|---|---|
| 3,710,483 | 1/1973 | Morgan et al. | 29/753 |
| 4,031,613 | 6/1977 | Brown et al. | 29/753 X |
| 4,178,679 | 12/1979 | Lichtenstein | 29/753 X |

*Primary Examiner*—Carl E. Hall

[57] ABSTRACT

A wire insertion guide may be used with a wide variety of closed barrel electrical contacts. The wire insertion guide includes a housing, a movable funnel located within the housing, a fixed funnel nested within the movable funnel, and a contact holder mounted in spaced relation with the movable funnel.

The wire insertion guide is used in concert with a crimper assembly, but is a separate apparatus, and may be used with a wide variety of crimper assemblies either of the manual or automatic type.

6 Claims, 4 Drawing Figures

WIRE INSERTION GUIDE

The present invention relates to apparatus for use in securing flexible wire to pin or socket-type contacts.

The fields of microcircuitry, analog computers, switching systems and related applications require connectors composed of a flexible conductor mounted at its end to a pin or socket-type contact. These connectors are used to form breakable connections between receptacles. Because of the large number of applications for such conductors, it has become necessary to produce the same in high volume. In addition, the reliability of these connectors is most important. Should the contact become dislodged from its flexible conductor, it may be difficult to remove from a receptacle.

Conventionally, the conductor is secured to a contact by soldering, wire-wrapping or insulation displacement and crimping. With the passage of time, crimp-type connectors have become predominant because of their economy, reliability and ease of control in production. In many applications, the crimp-type connector offers superior performance and has become increasingly popular. The present invention relates to apparatus for forming such crimp-type connectors.

Paralleling the popularity and improvements in the design and fabrication of crimp-type connectors is the demand for smaller of such crimp-type connectors. The use of such smaller connectors generates greater demands on the production techniques used in the manufacture of such conductors, and has created a need for enhanced precision and performance from both machines and operators. The machines must be efficient, accurate and reliable, and the operators must have steadier hands, clearer vision and better coordination.

Another problem inherent in the manufacture of crimp-type connectors, and one which the present invention is especially designed to overcome, is the tendency for one or more strands of conductor wire to separate from the reminder of such conductor wire and to fail to be received by the contact. This results in a weakened connection and a connector of poor reliability. In military applications, one dislodged strand will cause a conductor to be rejected.

It is therefore an object of the present invention to provide an apparatus for crimping a contact about a conductor which permits a high-volume manufacture.

It is yet another object of the present invention to produce an apparatus which provides for the accurate and uniform insertion of conductors into the contacts.

It is a further object of the present invention to provide apparatus which can be used with thin wires and small contacts.

It is yet a further object of the present invention to provide apparatus which prevents the separation of conductor wire strands prior to insertion.

It is yet a further object of the present invention to provide a wire insertion guide that can be used with a wide variety of crimper assemblies.

In accordance with an illustrative embodiment demonstrating objects and features of the present invention, wire insertion guides can be provided for use with a wide variety of closed barrel contacts, each of such contacts including a barrel of a first diameter and an end of a second diameter, the end being axially aligned with the barrel.

The wire insertion guide is used in conjunction with supply means having a feed chute. The wire insertion guide includes a housing and a fixed funnel mounted adjacent the top of said housing. The fixed funnel has a neck with a diameter greater than the larger of said first or second diameters, and is nested within a movable funnel. The movable funnel is adjustable from a closed position whereat its neck has a diameter substantially equal to the first diameter to an open position whereat its neck has a diameter greater than the larger of the first or second diameters.

The wire insertion guide is also used in conjunction with a crimper assembly, but it is emphasized that the wire insertion guide is a separate unit which may be used with a wide variety of crimper assemblies, either of the manual or the automatic variety. One of the outstanding features of the present wire insertion guide is its adaptability for use with a wide variety of preexisting crimper assemblies, and, as indicated, with a wide variety of closed barrel contacts.

The crimper assembly is positioned below the movable funnel, and includes a plurality of radially aligned crimping dies in normally-spaced relation with each other. The crimping dies define an opening in vertical axial alignment with the necks of the fixed and movable funnels.

A portion of the wire insertion guide which is mounted below the crimper assembly is the contact holding assembly, which includes an adjustable contact holder having a sleeve adapted to receive and retain the contact in position so that its barrel is radially aligned with the crimping dies.

In operation, initially the movable funnel is in its normally open position and the crimping dies are in their normally spaced position. A contact is fed by the supply means through the feed chute, end down, through the necks of the fixed and movable funnels, and comes to rest in the adjustable contact holder. When the contact comes to rest, it is positioned so that its barrel is axially aligned with the crimping dies. The operator then moves (by depressing a foot switch) the movable funnel to its closed position, and inserts the prestripped end of a conductor through the fixed funnel and into the barrel, which barrel is now encompassed by the neck of the movable funnel. It will be noted that no strand of the prestripped wire can escape the barrel.

The operator next (by releasing the foot switch) simultaneously causes the crimping dies to be momentarily urged against a barrel and adjusts the movable funnel to its open position. The now completed conductor/contact assembly may be removed, and the wire insertion guide is now prepared to receive the next contact from the supply means.

Those skilled in the art will appreciate that wire insertion guides made in accordance with the present invention have several advantages over conventional systems. For example, the wire insertion guide provides for the automatic placement of the contact so that its barrel is properly aligned, and therefore will properly be reacted against by the crimping dies. Thus the contact is not likely to be misaligned during the crimping operation. Further, because there is provided a funnel with a large neck (the fixed funnel) facilitating the entry of the contact, through it and down into another funnel (the movable funnel) which substantially encompasses the barrel, strands of the connector wire cannot escape the barrel.

Finally, the wire insertion guide is a separate apparatus from the crimping assembly and can be used with a wide variety of crimper assemblies.

The above description of the present invention will be more fully appreciated by reference to the following detailed description of a presently preferred but nonetheless illustrative embodiment in accordance with the invention, when taken in connection with the acompanying drawing, wherein.

Figure 1:
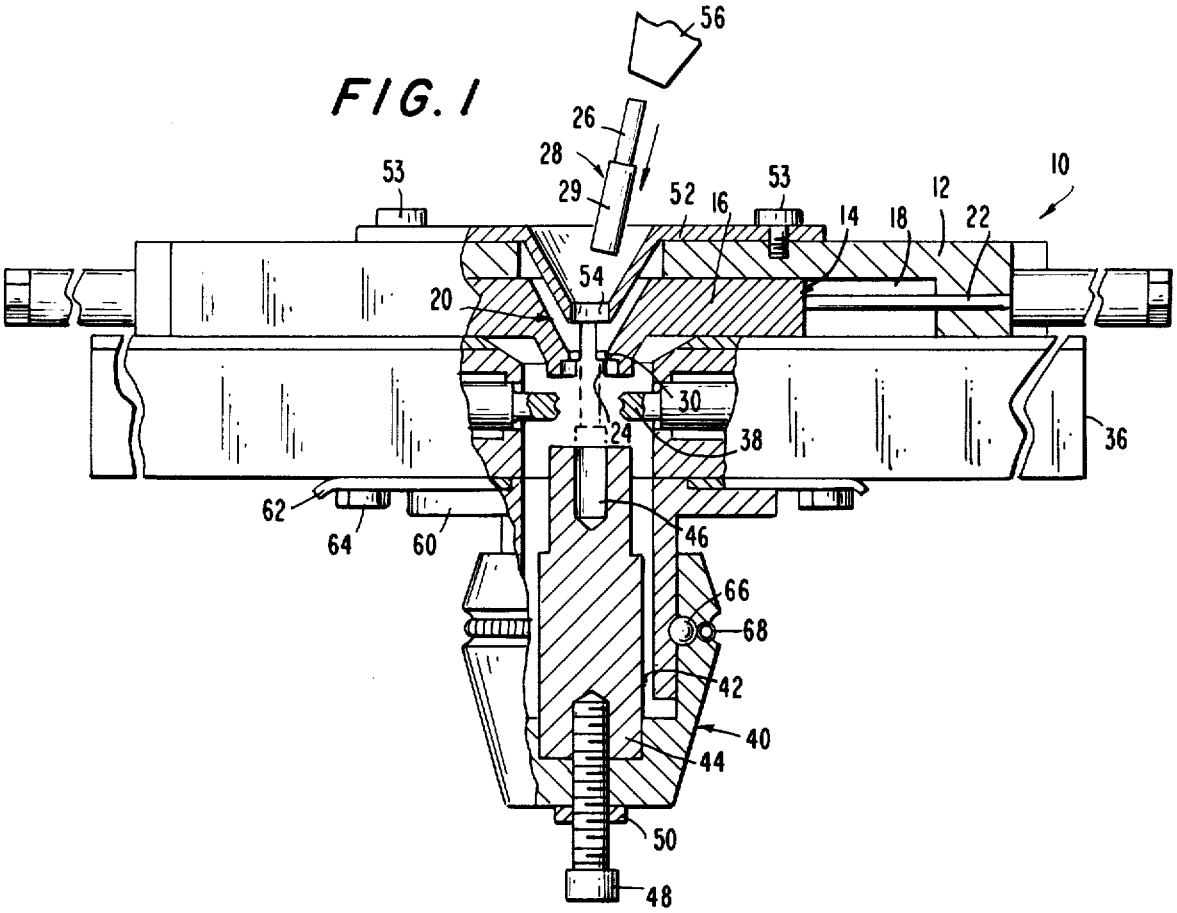
FIG. 1 is a sectional view of an apparatus made in accordance with the present invention, showing the movable funnel in its initial, open position.

Turning to the drawings, and particularly to FIG. 1, an apparatus made in accordance with the present invention is generally designated by the reference numeral 10.

Figure 2:
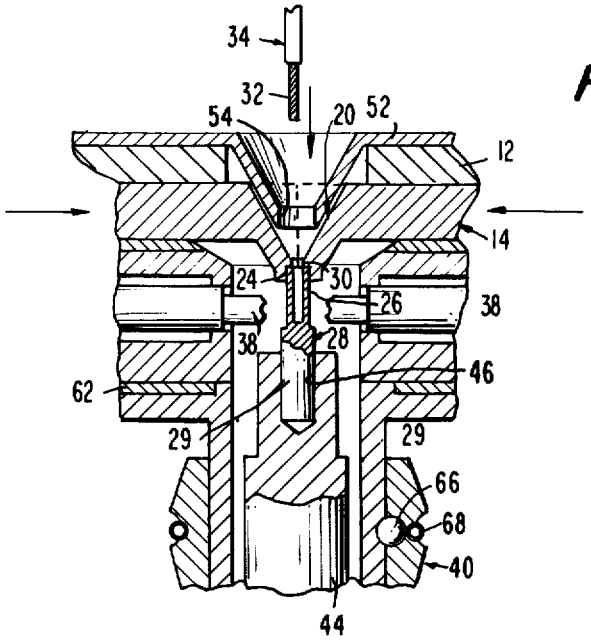
FIG. 2 is an expanded sectional view, showing the contact resting within the adjustable contact holder, and the movable funnel in its closed position.
Figure 3:
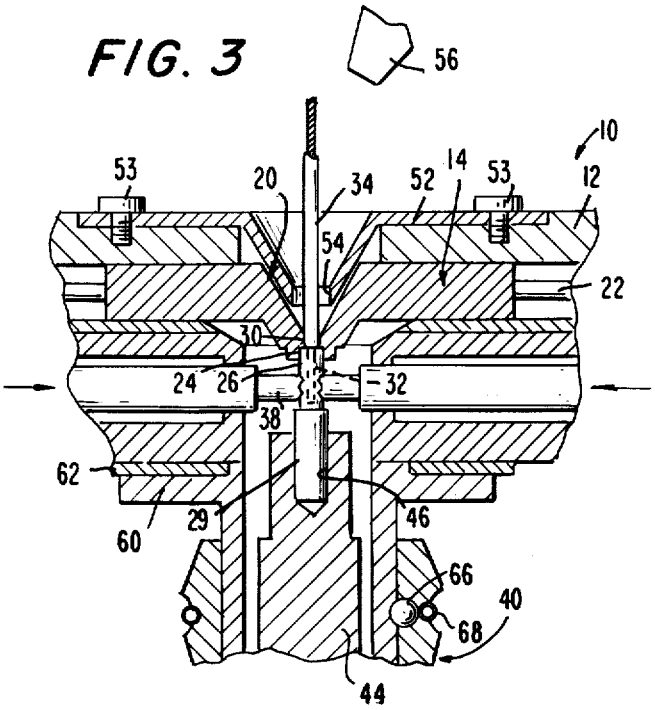
FIG. 3 is a sectional view showing the crimping dies urged against the barrel, and the movable funnel closed.
Figure 4:
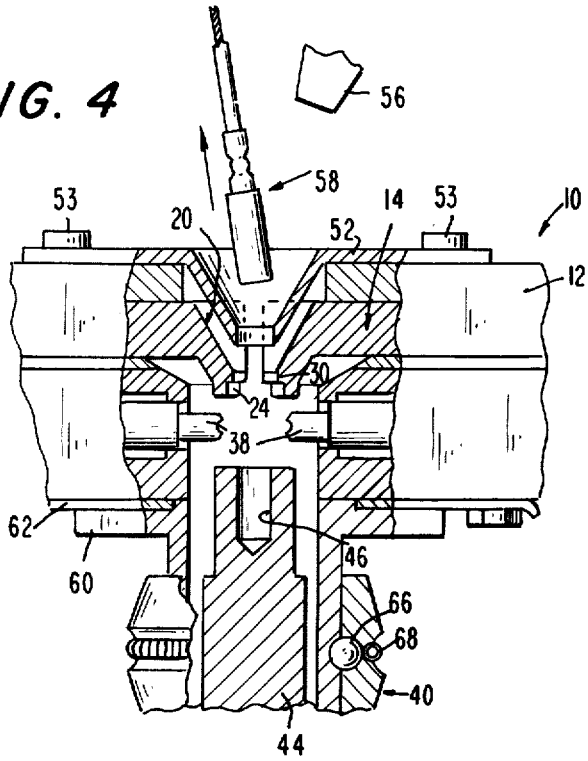
FIG. 4 is a sectional view showing the completed contact/connector assembly being withdrawn, with the movable funnel returned to its initial, open position.

Wire insertion guide 10 includes housing 12 in which is located movable funnel 14. Movable funnel 14 is composed of horizontal sections 16, each of which is slidably mounted within sleeve 18 of housing 12. Each of horizontal sections 16 terminates in a conical section 20. Mounted to horizontal section 16 at their ends remote from conical sections 20 are rods 22 which are coupled with a positioning means (not shown) through which the operator can adjust (by means of a foot pedal, also not shown) movable funnel 14 from its closed position as shown in FIGS. 2 and 3 to its open position as shown in FIGS. 1 and 4. It is emphasized that the wire insertion guide can be used with a variety of positioning means, which are well known to those skilled in the art. Accordingly, the positioning means (which may be activated by a foot switch) will not be described in detail.

Each of conical sections 20 terminates at its end remote from horizontal member 16 in a vertically-extending cylindrical sections 24, which cylindrical sections 24 combine, when movable funnel 14 is in its closed position, to define a neck which has a diameter substantially equal to the diameter of barrel 26 of contact 28. The contact 28 shown in this illustrative embodiment is of the socket type, but as will be appreciated by those skilled in the art, a pin-type contact can also be used.

Each of cylindrical sections 24 also includes an arcuate shoulder section 30 as can best be seen by reference to FIG. 4. Arcuate shoulder sections 30 meet to define a neck of diameter smaller than the diameter of barrel 26 of contact 28, and larger than prestripped end 32 of conductor 34.

Turning to FIG. 1, it can be seen that wire insertion guide 10 is used in connection with crimper assembly 36. It is emphasized that wire insertion guide 10 may be used separate from any particular crimper assembly, and that crimper assembly 36 is not part of the invention described herein. Accordingly, crimper assembly 36 will not be described in detail.

Crimper assembly 36 is removably mounted below movable funnel 14 of wire insertion guide 12, and includes crimping dies 38. Crimping dies 38 are in a normally open position and define an opening which is in vertical axial alignment with the neck defined by cylindrical sections 24 of movable funnel 14. Crimper assembly 36 may be activated, so as to (by means well known to those skilled in the art, and which will not be described in detail) momentarily urge crimping dies 38 away from their normally open position as shown in FIGS. 1, 2 and 4 to a position urging against barrel 26 of contact 28 as shown in FIG. 3.

A portion of wire insertion guide 10 located below crimper assembly 36 is the contact holding assembly generally designated by reference numeral 40. Contact holding assembly 40 includes sleeve 42. Adjustably mounted within sleeve 42 is contact holder 44 in which is formed sleeve 46 as can best be seen by reference to FIG. 4. Sleeve 46 is in vertical axial alignment with the opening defined by crimping dies 38 and the neck of movable funnel 14. Sleeve 46 is of a height less than that of end 29 of contact 28, and is of a diameter slightly larger than that of end 29, so that contact 28 can be removably inserted into it.

Contact 44 is vertically adjustably mounted within sleeve 42 by means of adjusting screw 48 which is provided with lock nut 50. By adjusting adjusting screw 48 and then tightening lock nut 50, contact holder 44 can be vertically adjusted within sleeve 42, so that when the contact 28 is resting in position in sleeve 46, as can be seen by reference to FIGS. 2 and 3, barrel 26 of contact 28 is in radial alignment with crimping dies 38 of crimper assembly 36.

Contact holding assembly 40 is secured to crimper assembly 36 by action of bracket 60. Bracket 60 is mounted to crimper assembly 36 by means of clamp 62 which is threaded to receive screw 64 which are tightened into matching threads (not shown) included in crimper assembly 36.

Bracket 60 is mounted to contact holding assembly 40 by means of detent ball 66 which is located therewithin. Retaining spring 68 urges detent ball 66 against the curved portion of bracket 60, thus retaining contact holding assembly 40 in position.

Mounted above movable funnel 14 and nested therewithin is fixed funnel 52. Fixed funnel 52 is mounted to housing 12 by means of screws 53. Fixed funnel 52 terminates in neck 54, which neck 54 has a diameter larger than the diameters both of end 29 and barrel 26 of contact 28, thus always allowing contact 28 to be freely insertable in and out of fixed funnel 52.

Mounted above fixed funnel 52 is feed chute 56 which is connected to supply means (not shown) which ejects a series of contacts 28, at the operator direction, into fixed funnel 52 as can be seen by reference to FIG. 1. Feed chute 56 is positioned not to interfere with the removal of completed contact/conductor assembly 58, as shown in FIG. 4.

In operation, it its initial condition, movable funnel 14 is in its normally open position as shown in FIGS. 1 and 4, and crimping dies 38 are in their normally spaced position also as shown in FIGS. 1 and 4. A contact 28 is fed by the supply means through feed chute 56 through neck 54 of fixed funnel 52, through the neck defined by arcuate shoulders 30 of movable funnel 14 and comes to rest in sleeve 46 of contact holder 44. Contact holder 44 has been vertically adjusted by means of adjusting screw 48 and lock nut 50 so that with the contact 28 in position, retained within sleeve 46, barrel 26 of contact 28 is radially aligned with crimping dies 38 of crimping assembly 36. The operator (by means of a foot switch, not shown) adjusts movable funnel 14 into its closed position, and conductor 34 is inserted through neck 54 and into barrel 26 of contact 28, which barrel 26 is now encompassed by the neck defined by conical sections 24 of movable funnel 14. It will be noted that no strand of the prestripped end 32 of conductor 34 can escape barrel 26.

With prestripped end 32 now encompassed by barrel 26, the operator releases the foot switch which causes crimping dies 38 of crimper assembly 36 to momentarily urge against barrel 26 of contact 28 as can be seen by reference to FIG. 3. This action causes barrel 26 to crimp prestripped end 32 of conductor 34, thus causing prestripped end 32 to be permanently retained within the now-crimped barrel 26.

Simultaneously therewith, movable funnel 14 is adjusted to its open position, the operator removes completed contact/conductor assembly 58, and the next contact 28 is positioned to be fed into wire insertion guide 10. The apparatus is now prepared for rapid repetition of the operation.

What is claimed is:

1. A wire insertion guide for use with a closed barrel electrical contact having a barrel axially aligned with an end, said barrel having a first diameter and said end having a second diameter, said wire insertion guide comprising:

a housing;

a movable funnel located within said housing, said movable funnel having a neck adjustable from a first size substantially equal to said first diameter to a second size larger than the larger of said first and second diameters;

a fixed funnel nested within said movable funnel, said fixed funnel having a neck of diameter larger than the larger of said first and second diameters;

a contact holder mounted in spaced relation with said movable funnel, said contact holder including a sleeve in axial alignment with the necks of said fixed and said movable funnels, said sleeve being of a height greater than that of said end, and having a diameter slightly larger than that of said end.

2. Apparatus in accordance with claim 1 wherein said sleeve is vertically adjustable within said contact holder.

3. Apparatus in accordance with claim 1 wherein the diameter of the barrel of said contact is larger than the diameter of the end of said contact.

4. Apparatus in accordance with claim 1 wherein the diameter of the barrel of said contact is equal to or smaller than the diameter of the end of said contact.

5. A wire insertion guide for use with a closed barrel contact having a barrel axially aligned with an end, said barrel having a first diameter, and said end having a second diameter, and further for use in conjunction with a crimper assembly, said crimper assembly having a plurality of normally spaced crimping dies in radial alignment with each other, and defining an opening, said wire insertion guide comprising:

a housing;

a movable funnel located within said housing and adjustable from a first size substantially equal to said first diameter to a second size larger than the larger of said first and second diameters;

a fixed funnel nested within said movable funnel, said fixed funnel having a neck of diameter larger than said first and said second diameters, said fixed and said movable funnels being mounted above said crimper assembly, with the necks of said fixed and said movable funnels in vertical axial alignment with said opening;

a contact holder mounted below said crimper assembly, said contact holder including a sleeve in axial alignment with the necks of said fixed and said movable funnels, said sleeve having a height greater than that of said end, and a diameter slightly larger than the diameter of said end.

6. Apparatus in accordance with claim 5 wherein said crimper assembly is removably mounted to said housing and to said contact holder.

* * * * *